US012359518B1

(12) United States Patent
Bringham

(10) Patent No.: US 12,359,518 B1
(45) **Date of Patent: *Jul. 15, 2025**

(54) RESETTABLE ELEMENT BACK-UP SYSTEM

(71) Applicant: D&L Manufacturing, Inc., Tulsa, OK (US)

(72) Inventor: Heath Bringham, Sand Springs, OK (US)

(73) Assignee: D&L Manufacturing, Inc., Tulsa, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/542,149

(22) Filed: Dec. 15, 2023

Related U.S. Application Data

(63) Continuation of application No. 17/534,141, filed on Nov. 23, 2021, now Pat. No. 11,851,962.

(60) Provisional application No. 63/117,256, filed on Nov. 23, 2020.

(51) Int. Cl.
*E21B 23/06* (2006.01)
*E21B 33/12* (2006.01)
*E21B 33/128* (2006.01)

(52) U.S. Cl.
CPC ..... *E21B 23/06* (2013.01); *E21B 33/1216* (2013.01); *E21B 33/128* (2013.01)

(58) Field of Classification Search
CPC ..... E21B 23/06; E21B 33/128; E21B 33/1216
See application file for complete search history.

(56) References Cited

U.S. PATENT DOCUMENTS

| | | | | |
|---|---|---|---|---|
| 2,921,633 | A * | 1/1960 | Baker | E21B 33/1216 277/338 |
| 4,289,200 | A * | 9/1981 | Fisher, Jr. | E21B 23/06 166/182 |
| 4,572,289 | A * | 2/1986 | Rosenthal | E21B 23/06 166/123 |
| 5,941,306 | A * | 8/1999 | Quinn | E21B 23/06 166/120 |
| 11,851,962 | B1 * | 12/2023 | Bringham | E21B 33/128 |
| 2013/0112398 | A1 * | 5/2013 | White | E21B 33/128 277/342 |
| 2013/0146277 | A1 | 6/2013 | Bishop | |
| 2013/0213635 | A1 * | 8/2013 | Carro | E21B 33/1295 166/120 |
| 2018/0087347 | A1 | 3/2018 | Rochen et al. | |
| 2019/0017347 | A1 | 1/2019 | Kendall et al. | |
| 2019/0203558 | A1 * | 7/2019 | Richards | E21B 33/1216 |

* cited by examiner

*Primary Examiner* — David Carroll
(74) *Attorney, Agent, or Firm* — GableGotwals

(57) ABSTRACT

A downhole tool of this disclosure includes a set/reset ring located adjacent a gauge ring which is opposite at least one sealing member. The set/reset ring is arranged to move between an unset diameter at least equal to the unset diameter of the sealing member and a set diameter at least equal to the set diameter of the sealing member. The set/reset ring is like a coil spring having at least two full turns and, therefore, a 360° face surface when in its unset and set diameters. When a setting mandrel moves toward the sealing member, the sealing member moves to its set diameter and the set/reset ring moves into its set diameter. When the setting mandrel moves away from the sealing member, the sealing member returns to its unset diameter and the set/reset ring returns to its unset diameter.

13 Claims, 11 Drawing Sheets

RESETTABLE ELEMENT BACK-UP SYSTEM

CROSS-REFERENCE TO CO-PENDING APPLICATIONS

This application is a continuation of U.S. application Ser. No. 17/534,141 filed Nov. 23, 2021, which claims the benefit of, and priority to, U.S. 63/117,256 for Resettable Element Backup System filed Nov. 23, 2020, which is incorporated herein by reference.

FIELD OF THE INVENTION

The subject matter of this disclosure relates to a tool for an oil well. More particularly, the disclosure relates to a tool having sealing elements, such as packers and bridge plugs. The invention relates to an element for preventing seal extrusion wherein the element is resettable.

BACKGROUND

The resettable element back up system of downhole tools, such as packers and bridge plugs, utilizes a rubber seal element for sealing against an inside wall of casing. Under high temperatures, the rubber of the rubber seal element, e.g., 90 Duro Nitrile, becomes softer. Under high pressures the seal element can extrude between a gap between a gage ring and an inside wall of the casing. The smaller the tool, the larger the extrusion gap. The extrusion gap may range from 1/16 inch to 1/4 inch.

Example pressures may be in a range of 8,000 to 10,000 psi and up to 15,000 psi or greater. Example temperature on the outside of the tool may be 300° F. and exceed 350° F. at 15,000 psi (high temperature and high pressure).

Elastomeric coated non-extrusion rings with stainless steel mesh inserts ("ECNER") and other ductile shoe and petal methods have been used to prevent extrusions, but, to inventor's knowledge, elastic rings have not been used.

SUMMARY

There is a need for a resettable repositionable backup system for packers and bridge plugs with a reliable and positive ability to return to original form.

In one embodiment, a packer assembly has a three-piece resilient sealing element system with a soft center element formed of 80 durometer nitrile and harder end elements formed of 90 durometer nitrile. The multi-durometer packer elements are used to seal in high and low pressure applications.

Embodiments of a resettable element of this disclosure utilize a spiral retaining ring, e.g., a SMALLEY® SPIROLOX® retaining ring such as, but not limited to, a SMALLEY® WSM-550™ retaining ring (for a 5.50" shaft size) or its equivalent. In other embodiments, a custom SMALLEY® was commissioned made of spring tempered 17-7 PH stainless steel and five turns with pie cut ends. The set/reset ring is relaxed when in a small diameter configuration and may expand to a larger outside diameter. The set/reset ring is preferably in the form of a spiral spring. The set/reset ring has no protruding ears or lugs and no gap (360° retaining surface).

In embodiments, the setting force required on the set/reset ring, and therefore the sealing member, is less than the re-setting force. In one embodiment, the set/reset ring has a 15,000 lb. setting force and resets with 1,000 lbs. of force. In one embodiment, the set/reset ring deployed between 5,000-10,000 lbs of force, with the target setting force of the rubber sealing elements at 15,000 lbs. As the setting force is reduced, the ring will normally start to reset once the setting force has been reduced to about 2,000 lbs.

The set/reset ring is relaxed when in a small configuration and is made to expand to a larger outside diameter. The use of the set/reset ring allows for use of softer sealing elements because the set/reset ring provides backup. The set/reset ring of this disclosure is capable of multiple sets. The set/reset ring strength and reset force can be varied by changing the cross section of the ring and the number of "turns" or spirals. In embodiments, the set/reset ring may have two to five turns, with three turns preventing the ring from sliding up. In both its set and unset positions, the ring presents a full 360° face surface to the sealing element.

The set/reset ring may be nested in a groove having a t-slot arranged to receive a complementary shaped lug. The set/reset ring may go over hose-clamped lugs. In the prior art, the lugs are usually on a permanent packer. In embodiments of this disclosure, the set/reset ring (wave spring) helps with return. The ring can be located outside of the packer, with its 360° face that prevents the rubber of the packer from pushing or extruding outward. And because of this arrangement, the rubber never touches the lugs.

Embodiments of a downhole tool of this disclosure include at least one sealing member arranged to move between an unset and a set position, the at least one sealing member having an unset diameter and a set diameter greater than the unset diameter; a gauge ring centered on and located opposite the at least one sealing member; a plurality of lugs received by the gauge ring and restrained by the gauge ring and constrained in an axial direction by the gauge ring but moveable radially outward a set/reset ring centered on the gauge ring and arranged about the plurality of lugs, the set/reset ring having a 360° set/reset surface and at least two full turns, the set/reset ring arranged to move between an unset diameter at least equal to the unset diameter of the at least one sealing member and a set diameter at least equal to that of the set diameter of the at least one sealing member as the plurality of lugs move radially outward and inward; and a setting mandrel, which is typically hydraulically actuated, arranged to move in a longitudinal direction toward and away from the at least one sealing member and, therefore, the toward and away from the gauge ring and the set/reset ring. The lugs may have an inclined surface (e.g. 45° angle or other predetermined angle effective for expanding the set/reset ring.

When the setting mandrel moves toward the at least one sealing member, the at least one sealing element moves to its set diameter and the set/reset ring moves to its set diameter as the lugs move radially outward. Each set diameter is constrained by the internal or inside diameter of the well casing into which the downhole tool is deployed. When the setting mandrel moves away from the at least sealing member, the at least one sealing member returns to its unset diameter and the set/reset ring returns to its unset diameter as the lugs move radially inward. When in the set position, the gauge ring contacts a centering ring spaced a predetermined distance from the gauge ring to act as a stop, limiting the axial travel of the gauge ring and, thereby, preventing the set/reset ring from being over expanded and the lugs dropping out of the gauge ring.

A force to move the set/reset ring, and therefore, the at least one sealing member into the set diameter is greater than the force to return to the unset diameter. The unset diameter of the set/reset ring may be in a range of 1/16 inch to 1/4 inch greater than the unset diameter of the at least one sealing element.

DETAILED DESCRIPTION

Figure 1:
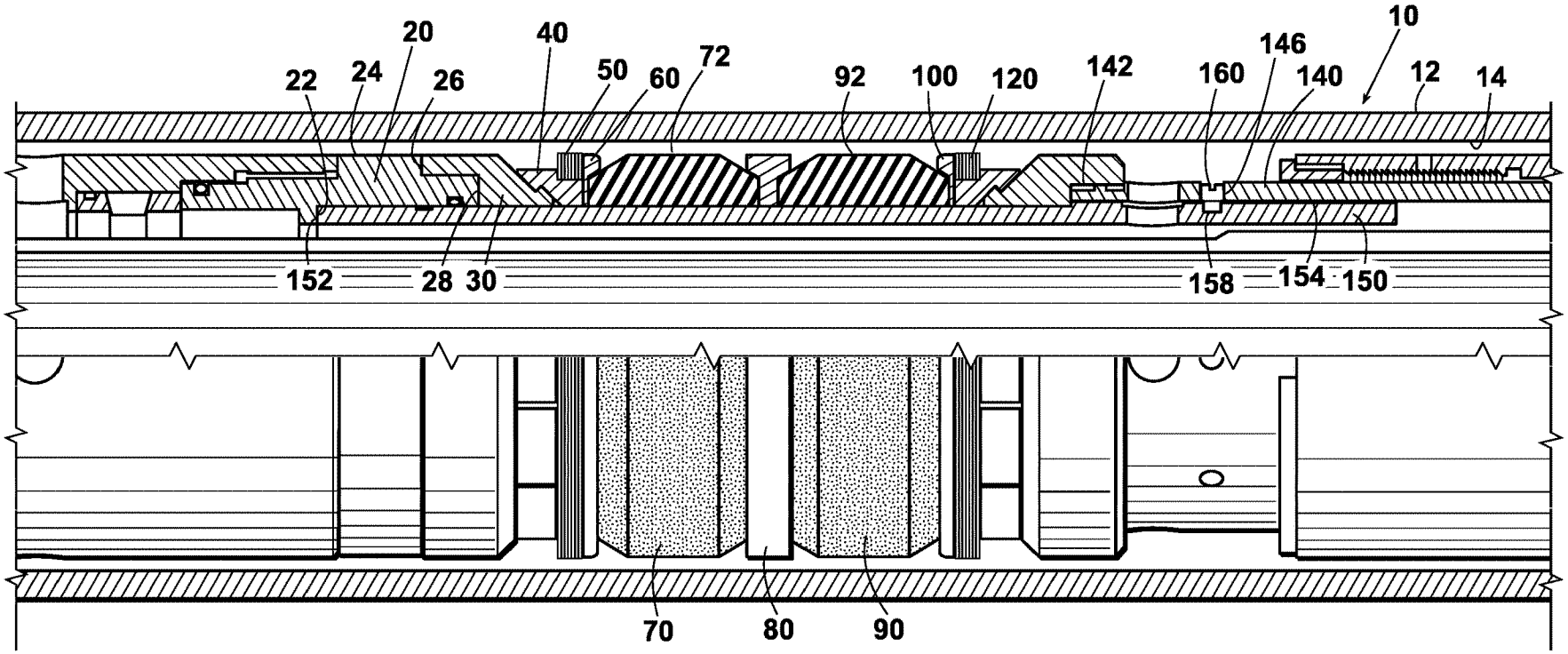
FIG. 1 is a cutaway view of a first embodiment of a resettable backup element system of this disclosure in an un-set configuration.

Embodiments of a downhole tool of this disclosure are retrievable and resettable and include at least one sealing member. After use, the rubber of the sealing elements can be changed out with new rubber and the tool redeployed. What makes the reset possible is a set/reset ring that is arranged as an axial spring, the ring requiring greater force to expand radially outward to its set position than it does to retract radially inward to its unset position. The reason for less force being required is the ring, when set, wants to "climb back" to its original, unset shape.

The ring is both a backup ring that in its set state contacts the casing wall, thereby preventing extrusion of the sealing member, and a return ring, letting all of the components of the tool more easily return or reset to their unset state. The set/reset ring makes it possible for a downhole tool including sealing elements like packers pass API tests for high pressure, high temperature applications. The set/reset ring is adaptable to a wide variety of downhole tools that include packers. In some embodiments, where the packer only has to hold pressure in one direction, a single set/reset ring may be used in connection with the sealing member or members. In embodiments where the packer must hold pressure in both directions, two set/reset rings may be used, one above and one below the sealing member or members.

Referring now to FIGS. 1-4, shown is an embodiment of a resettable backup element system, designated generally 10. Resettable backup element system 10 is located within casing 12. Casing 12 has an inside surface 14.

Upper connector 20 has an inner lip defining a lower surface 22. Upper connector 20 has an outside portion 24 that defines a lower surface 26. Upper connector 20 further defines lower end 28.

Figure 4:
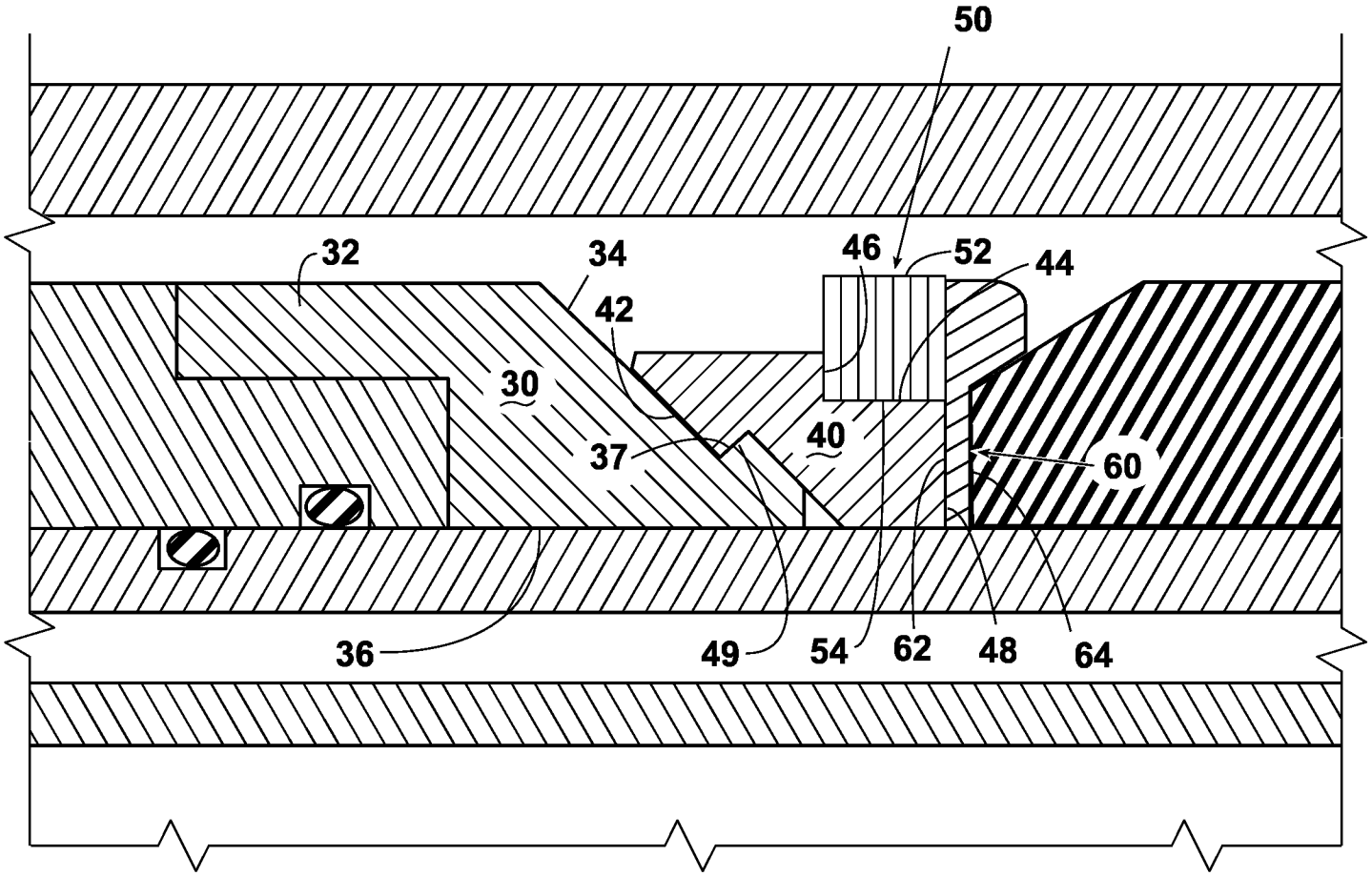
FIG. 4 is an enlarged cutaway view of the upper centering ring/upper lug interface of the embodiment of FIGS. 1-3.

As best seen in FIG. 4, upper centering ring 30 has an outer portion 32, a downwardly and outwardly facing slanted surface 34 and an inside surface 36. Downwardly and outwardly facing slanted surface 34 defines a protruding lip 37. Outer portion 32 has an upper surface adjacent to lower surface 26 of outside portion 24 of upper connector 20.

Still referring to FIG. 4, upper lug 40 has an upwardly and inwardly facing slanted surface 42, and an outside surface. The outside surface defines recessed area 44 and a downwardly facing lip 46. Upper lug 40 has a lower surface 48. Upwardly and inwardly slanted face 42 defines a protruding lip 49. Upwardly and inwardly slanted face 42 is in sliding engagement with downwardly and outwardly slanted lower face 34. Protruding lip 49 of upper lug 40 and protruding lip 37 of upper centering ring 30 make contact to limit sliding travel of upper lug 40 with respect to upper centering ring 30.

Upper set/reset ring 50 is received within recessed area 44 of upper lug 40. Upper set/reset ring 50 has an upper surface 52 adjacent to downwardly facing lip 46 of the outside surface of upper lug 40. Upper set/reset ring 50 has a lower surface 54.

Upper gauge ring 60, which may also be called a rubber retainer, has an upper surface 62 and a lower surface 64. Lower surface 64 defines a downwardly facing protrusion. Upper surface 62 is adjacent to lower surface 48 of upper lug 40. In some embodiments, the gauge ring 60 may be a flat ring (no inset), with the rubber wanting to climb up and over the rounded edges of the ring 60.

Upper resilient sealing member 70 has an upper surface adjacent to lower surface 64 of upper gauge ring 60. Upper resilient sealing member 70 has an outside surface 72 and a lower surface. Outside surface 72 is proximate to inside surface 14 of casing 12.

Rubber spacer 80 has an upper surface and a lower surface. The upper surface is adjacent to the lower surface of upper resilient sealing member 70.

Lower resilient sealing member 90 has an upper surface, an outside surface 92, and a lower surface. The upper surface is adjacent to the lower surface of rubber spacer 80. Outside surface 92 is proximate to inside surface 14 of casing 12.

Figure 5:
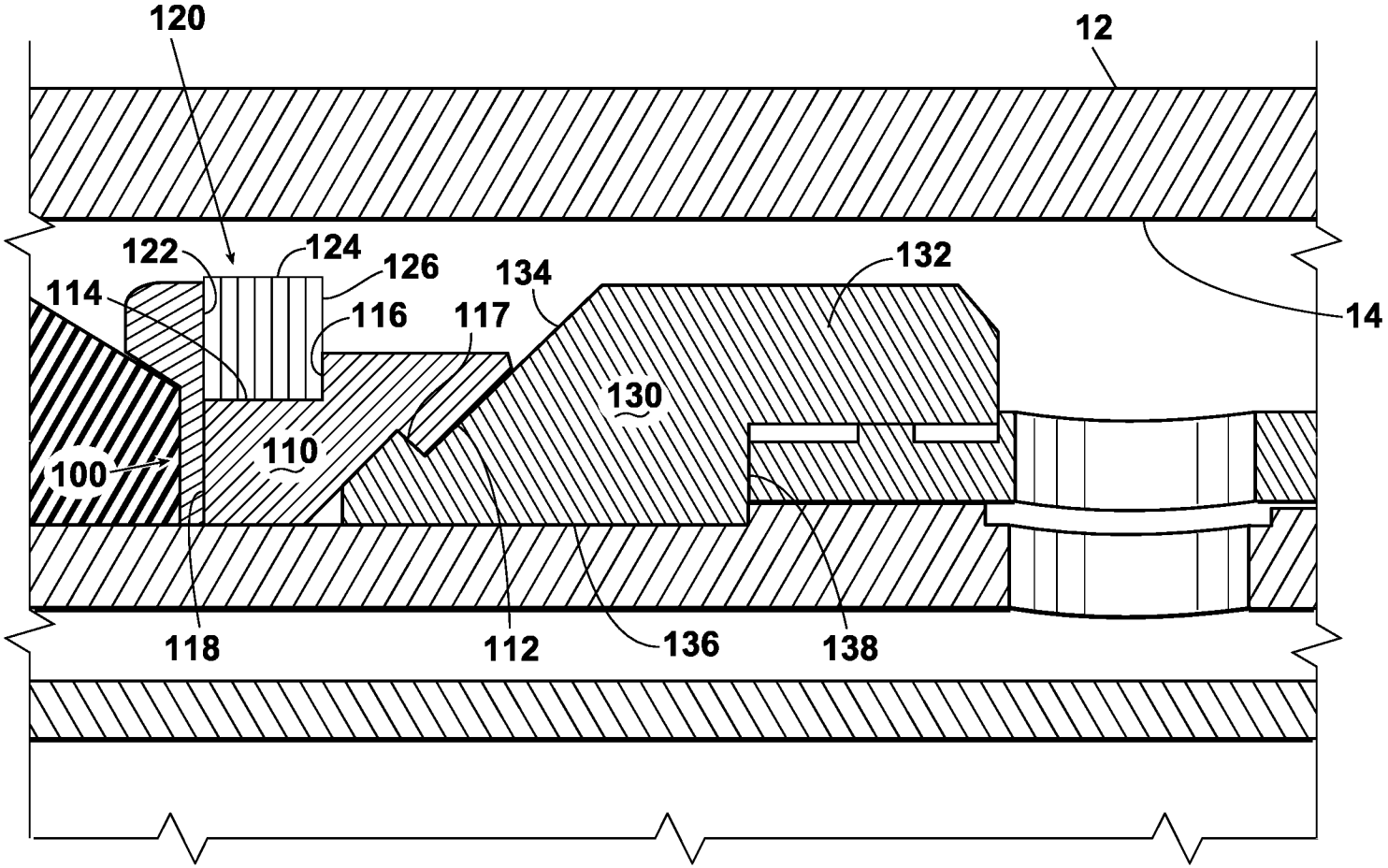
FIG. 5 is an enlarged cutaway view of the lower lug/lower centering ring interface of the embodiment of FIGS. 1-3.

As best seen in FIG. 5, lower gauge ring 100 has an upper surface that defines an upwardly facing protrusion. Lower gauge ring 100 also defines a lower surface. In some embodiments, the gauge ring 100 may be a flat ring (no inset), with the rubber wanting to climb up and over the rounded edges of the ring 100. Both gauge rings 60, 100 have fixed outside diameters, typically equal to the tool outside diameter.

Lower lug 110 has a downwardly and inwardly slanted face 112 and an outside surface. The outside surface defines a recessed area 114. The outside surface additionally defines an upwardly facing lip 116. Downwardly and inwardly slanted face 112 defines protrusion 117. Lower lug 110 has an upper surface 118. Upper surface 118 is adjacent to the lower surface of lower gauge ring 100.

Lower set/reset ring 120 has an upper surface 122, an outside surface 124, and a lower surface 126. Lower set/reset ring 120 is received within recessed area 114 of lower lug 110. Upper surface 122 is adjacent to the lower surface of lower gauge ring 100. Outside surface 124 is proximate to inside surface 14 of casing 12.

Lower centering ring 130 has an outer portion 132, an upwardly and outwardly facing slanted surface 134, and an inside surface 136. An inner recess defines a downwardly facing surface 138. Upwardly and outwardly facing slanted surface 134 defines protruding lip 139. Outer portion 132 has a lower surface. Upwardly and outwardly facing slanted surface 134 is slidably engaged with downwardly and inwardly facing slanted surface 112 of lower lug 110. Protruding lip 139 of upwardly and outwardly facing slanted upper face 134 engages protrusion 117 of downwardly and inwardly slanted face 112 of lower lug 110 when resettable element backup system 10 is in an unset configuration, as shown in FIG. 5.

Referring back to FIGS. 1-3, threaded member 140 has upper end 142 and a threaded outer portion 144. Threaded member 140 defines a lock nut orifice 146. Upper end 142 is received in the inner recess of lower centering ring 130 and terminates adjacent to downwardly facing surface 138 of the inner recess of lower centering ring 130.

Mandrel 150 has an upper end 152, a lower end, and an outside surface 154. Outside surface 154 defines a lock nut receptacle 158. Upper end 152 is adjacent to lower surface 22 of inner lip of upper connector 20.

Lock nut 160 is received in lock nut orifice 146 and passes through threaded member 140 for selectively engaging lock nut receptacle 158 of mandrel 150 for selectively slidably locking threaded member 140 and mandrel 150 together. The locking nut 160 is cut so that it can expand and the threads on threaded member 140 are angled such that the nut 160 moves in one (setting) direction but not the other (unsetting) direction. The nut 160 shears during unsetting. The same holds true of other locking nuts and threaded members that perform the same function.

In use, threaded member 140 of un-set resettable backup element system 10 (FIG. 1) is connected to mandrel 150, which is typically hydraulically actuated. As threaded member 140 is moved upwardly (leftward in FIGS. 1-3), upper centering ring 30 moves towards upper lug 40, thereby facilitating relative sliding therebetween and forcing upper set/reset ring 50 outwards towards inside surface 14 or casing 12. Similarly, lower centering ring 130 moves towards lower lug 110, thereby facilitating relative sliding therebetween and forcing upper set/reset ring 120 outwards towards inside surface 14 or casing 12. Upper resilient sealing member 70 and lower resilient sealing member 90 are compressed and expand outwardly such that outside surfaces 72 and 92 make contact with inside surface 14 of casing 12 (see, e.g., FIG. 2). Under high pressures, resilient members 70 and 90 tend to extrude between tool 10 and the inside surface 14 of casing 12, i.e., around outside ends of upper gauge ring 60, rubber spacer 80, and lower gauge ring 100.

Figure 2:
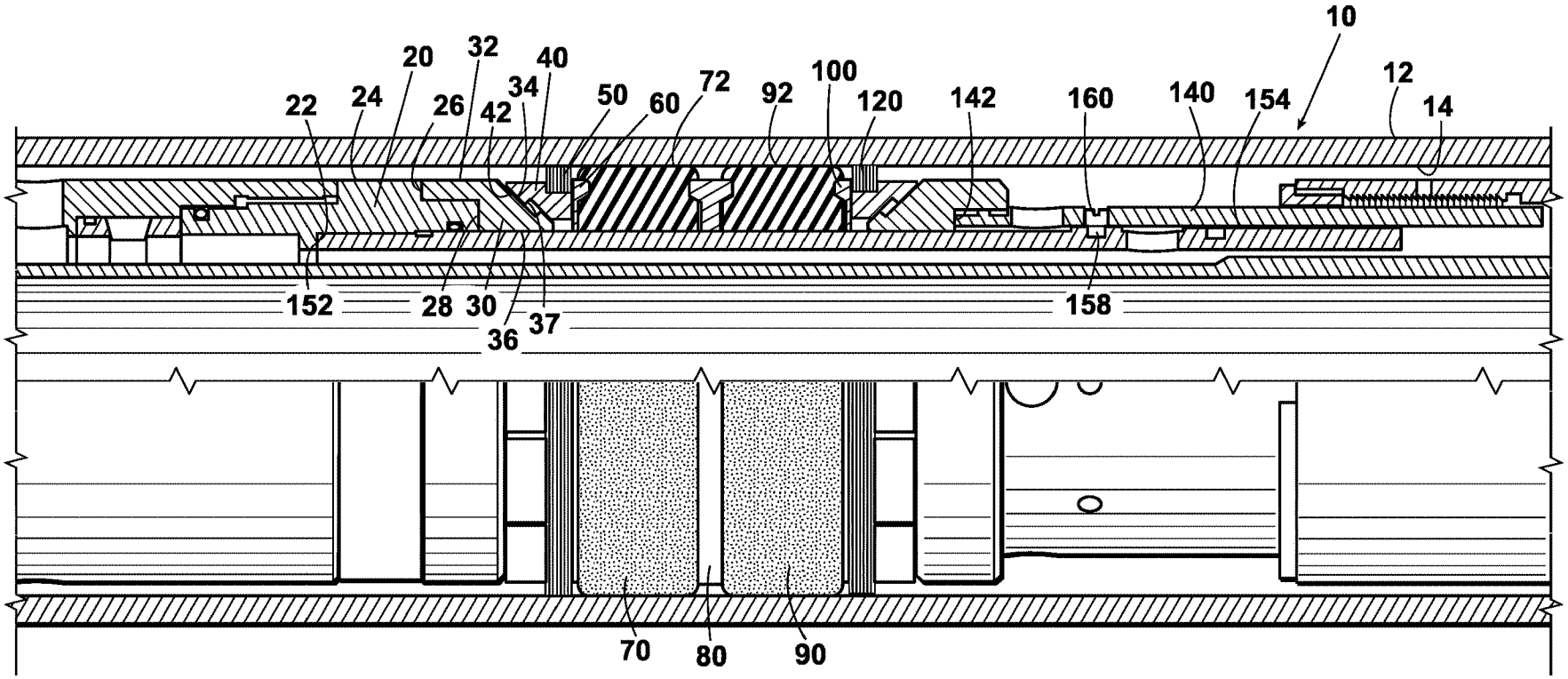
FIG. 2 is a cutaway view of the first embodiment in a set configuration.
Figure 3:
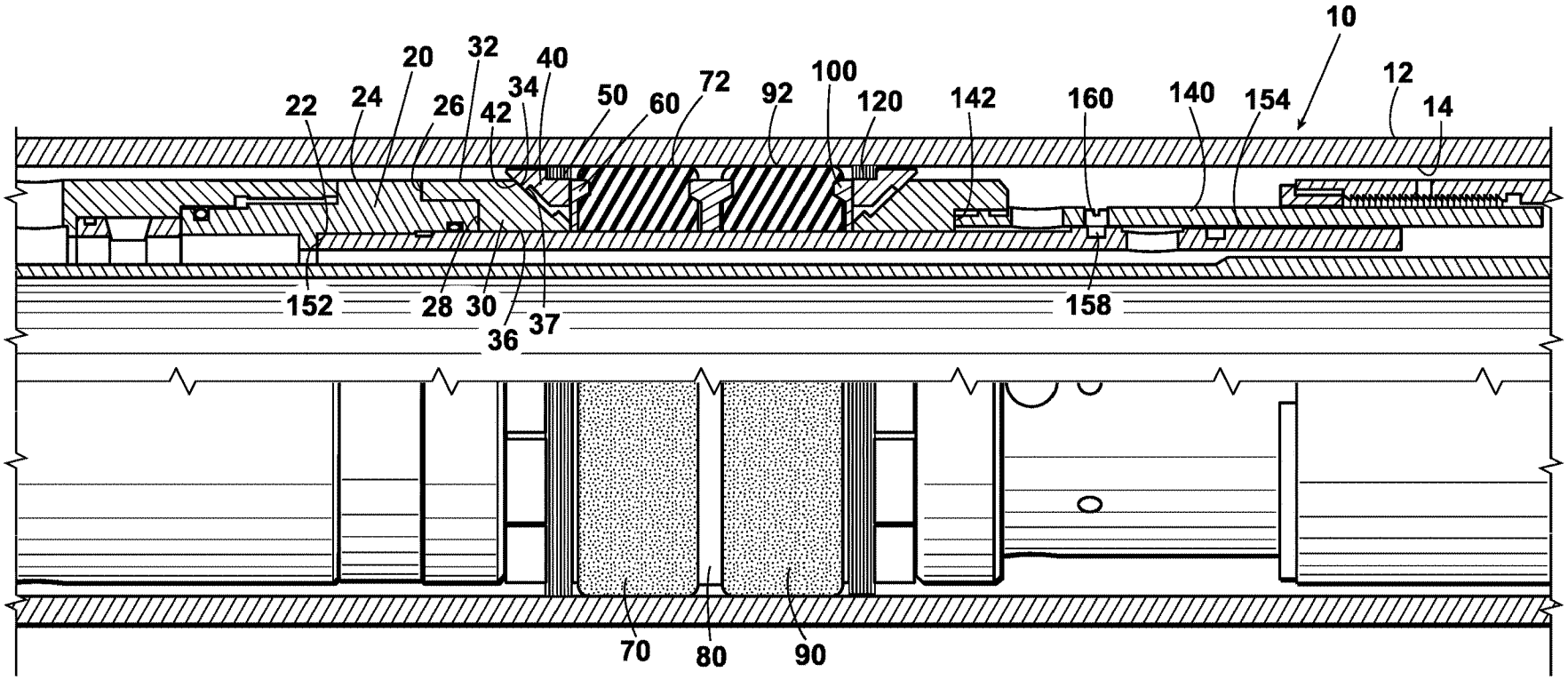
FIG. 3 is a cutaway view of the first embodiment in a set configuration with pressure applied.

As best seen in FIG. 3, upper set/reset ring 50 and lower set/reset ring 120 limit extrusion of resilient members 70 and 90 when resettable backup element system 10 is in a set configuration (FIGS. 2 and 3). When re-setting tool 10 in an un-set configuration, set/reset rings 50 and 120 retract along with lugs 40 and 110, respectively, such that set/reset rings 50 and 120 are re-set and ready for subsequent use.

Figure 6:
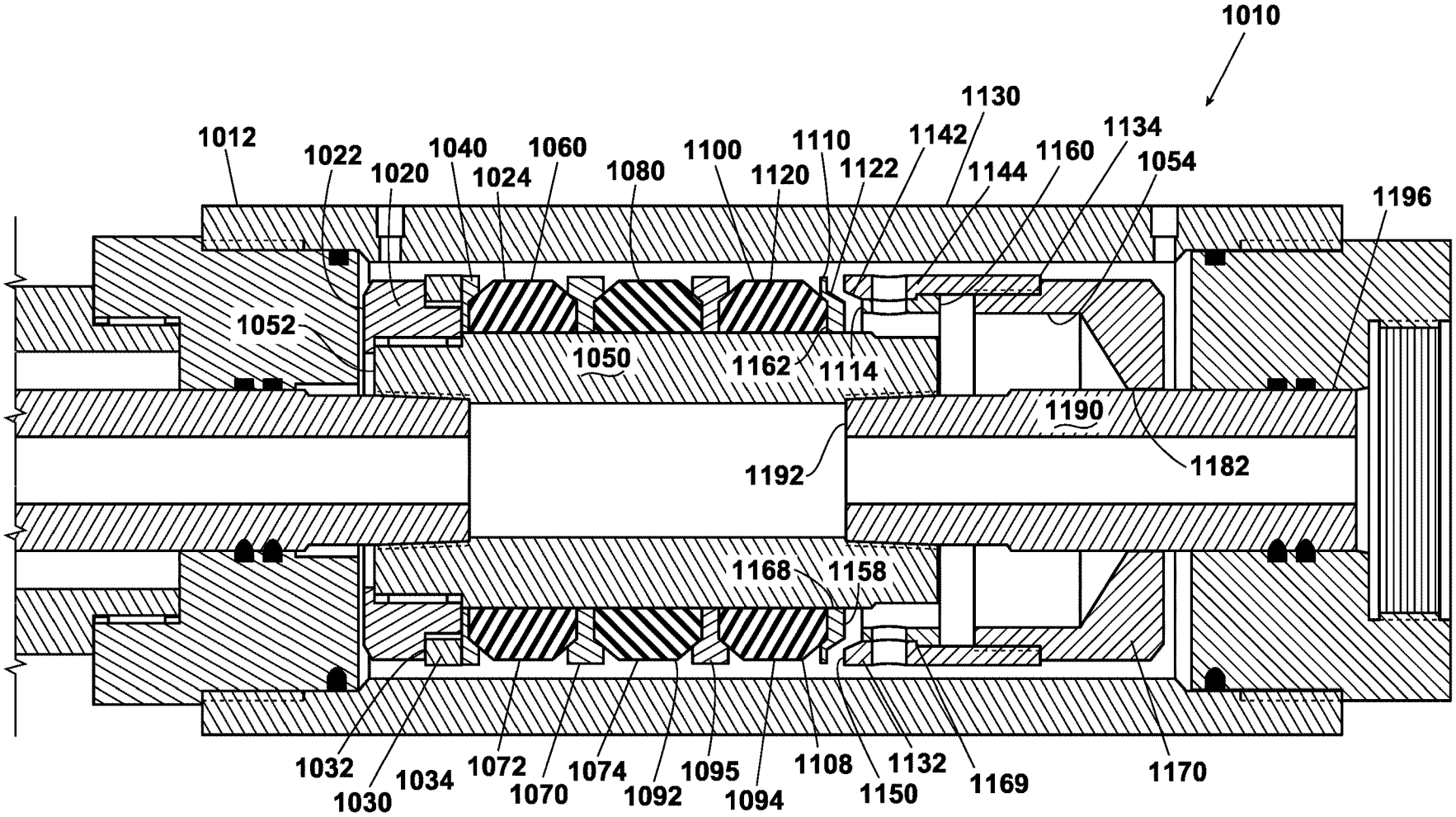
FIG. 6 is cutaway elevation view a test fixture for a resettable backup element system of this disclosure when in a relaxed configuration.
Figure 7:
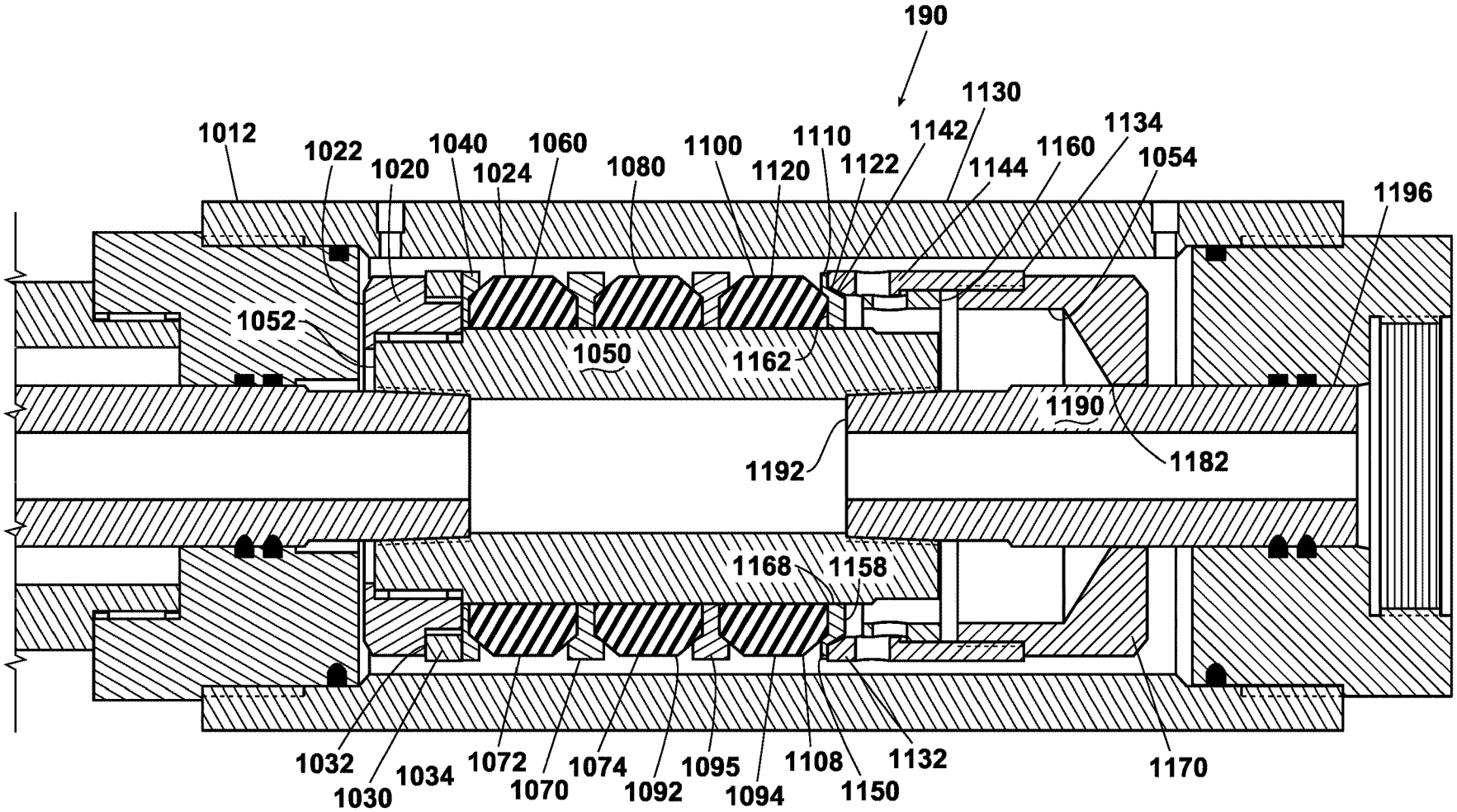
FIG. 7 is a cutaway elevation view of the system when mounted on the text fixture and in an extended configuration.
Figure 8:
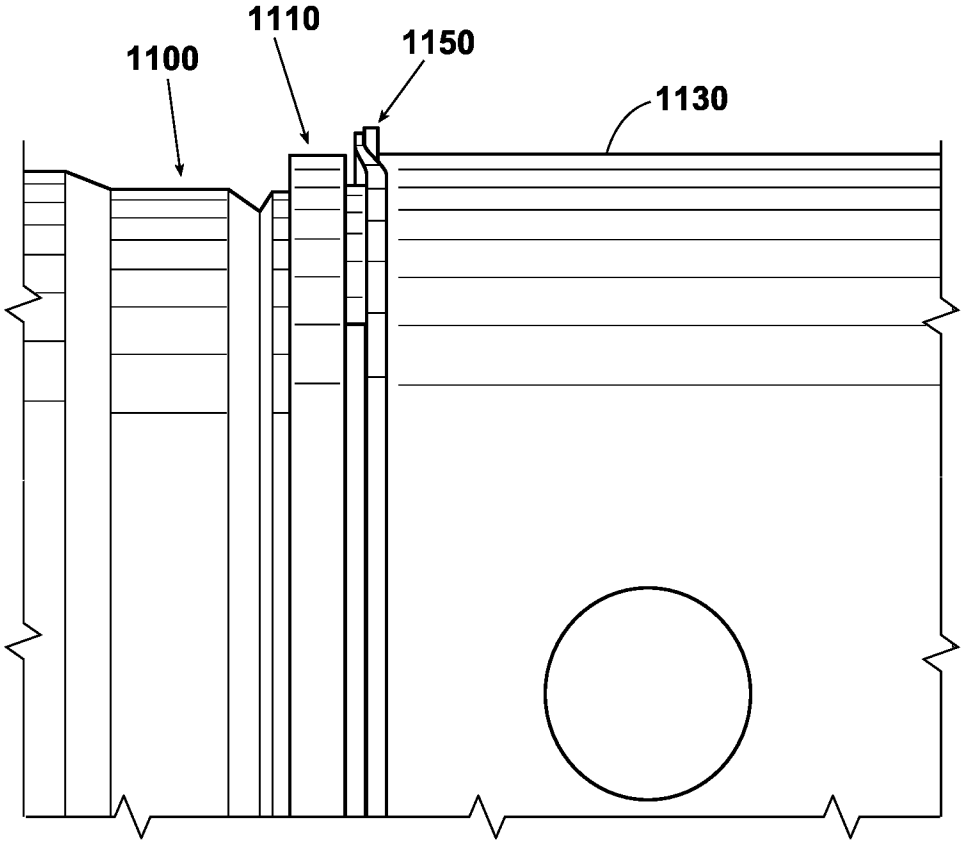
FIG. 8 is a shows a portion of the tool of FIGS. 6 and 7 when in the text fixture.
Figure 9:
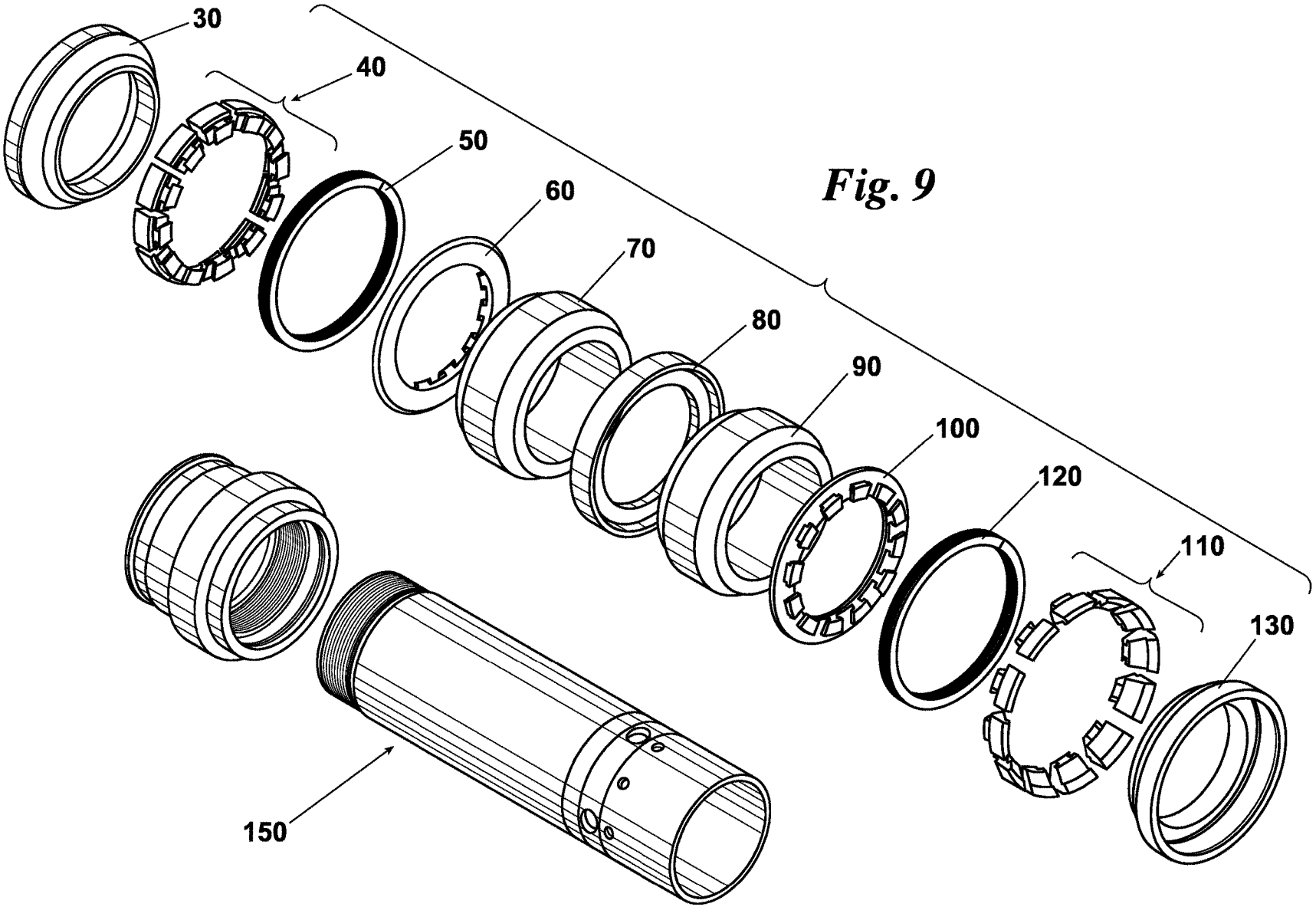
FIG. 9 is an exploded view of the retainer assembly including the set/reset ring.
Figure 10:
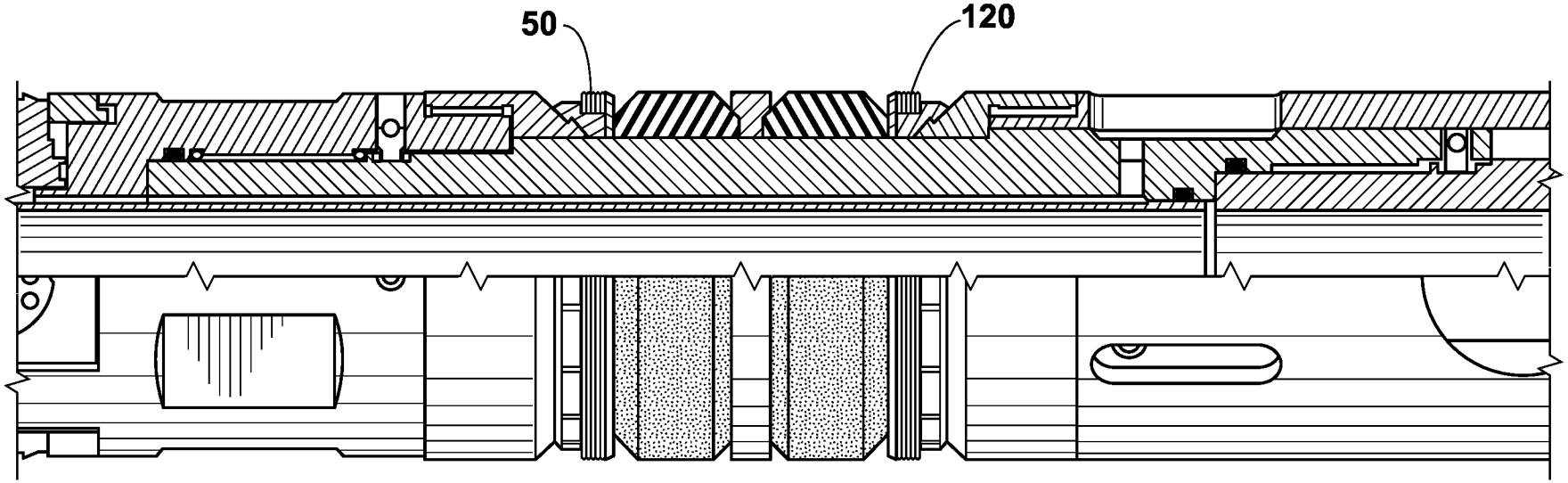
FIG. 10 is a partial view of a downhole tool including the retainer assembly of FIG. 9.
Figure 11:
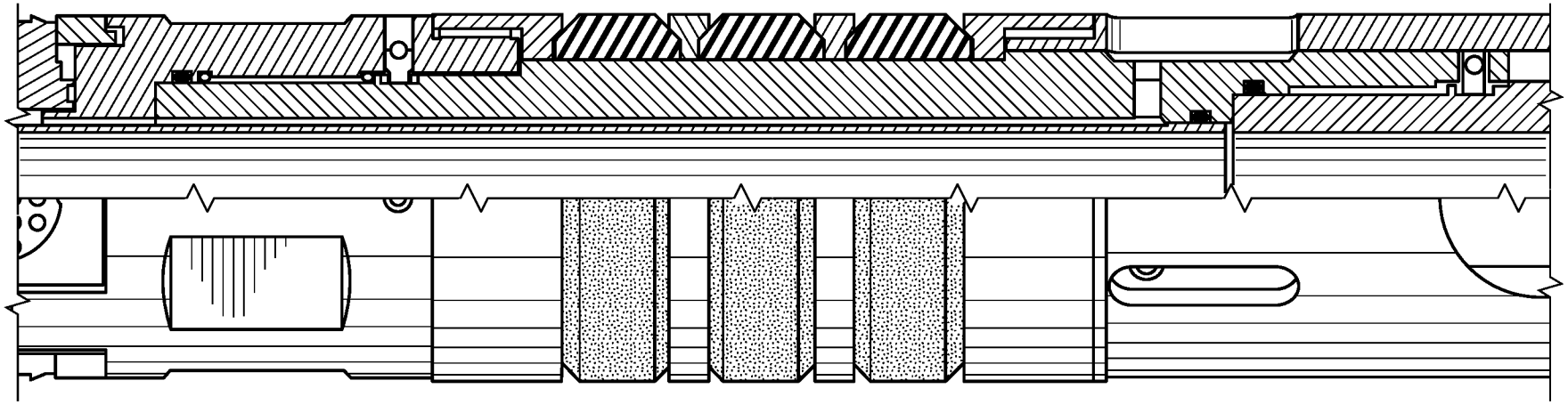
Fig. 11 ( PRIOR ART )
FIG. 11 is a partial view of a prior art tool. The tool may be retrofitted to accommodate embodiments of this disclosure

Referring now to FIGS. 6-8, a second embodiment of resettable element backup system is designated generally 1010. Resettable backup system 1010 is received in casing 1012. Resettable element backup system 1010 includes rubber mandrel cap 1020. Rubber mandrel cap 1020 has upper end 1022, lower end 1024, and an outside surface. The outside surface of lower end 1024 of rubber mandrel cap 1020 defines a circumferential recess.

Gauge ring 1030 has upper side 1032 and lower side 1034. Gauge ring 1030 is received in the circumferential recess of rubber mandrel cap 1020.

Gauge ring 1040 has an upper side and a lower side. The upper side is adjacent lower end 1024 of rubber mandrel cap 1020. The upper side is also adjacent lower side 1034 of gauge ring 1030.

Rubber mandrel 1050 has upper end 1052, lower end 1054, and an outside surface. Upper end 1052 is received within lower end 1024 of rubber mandrel cap 1020. Upper end 1052 of rubber mandrel 1050 connected to the hydraulic ram of the text fixture.

Upper resilient sealing element 1060 surrounds rubber mandrel 1050. Upper resilient sealing element 1060 has an upper side and a lower side. The upper side is adjacent the lower side of gauge ring 1030. Upper resilient sealing element 1060 defines an upper frusto-conical surface adjacent the upper side and defines a lower frusto-conical surface adjacent the lower side.

First rubber spacer 1070 has upper side 1072 and lower side 1074. First rubber spacer 1070 surrounds rubber mandrel 1050. Upper side 1072 of first rubber spacer 1070 is adjacent to the lower side of upper resilient sealing element 1060.

Middle resilient sealing element 1080 surrounds rubber mandrel 1050. Middle resilient sealing element 1080 has an upper side and a lower side. The upper side is adjacent lower side 1074 of first rubber spacer 1070. Middle resilient element 1080 defines an upper frusto-conical surface adjacent an upper side and defines a lower frusto-conical surface adjacent a lower side.

Second rubber spacer 1090 has upper side 1092 and lower side 1094. Second rubber spacer 1090 surrounds rubber mandrel 1050. Upper side 1092 of second rubber spacer 90 is adjacent to the lower side of middle resilient sealing element 80.

Lower resilient sealing element 100 surrounds rubber mandrel 50. Lower resilient sealing element 100 has an upper side and a lower side. The upper side is adjacent lower side 1094 of second rubber spacer 1090. Lower resilient sealing element 1100 defines an upper frusto-conical surface adjacent the upper side and lower frusto-conical surface 1108 adjacent to the lower side.

Gauge ring 1110 has an upper side, lower side 1114, an outside surface, and an inside surface. The upper side of gauge ring 1110 defines upper frusto-conical inner surface 1120 and lower frusto-conical inner surface 1122. Upper frusto-conical inner surface 1120 is adjacent to lower frusto-conical surface 1108 of lower resilient sealing element 1100.

Ring retainer 1130 has upper end 1132, lower end 1134, an outside surface, and an inside surface 1138. Upper end 1132 of ring retainer 1130 is proximate to lower side 1114 of gauge ring 1110. Ring retainer 1130 defines an orifice that communicates the outside surface and the inside surface. Ring retainer 1130 defines inside frusto-conical surface 1142 adjacent upper end 1132. Ring retainer 1130 defines downwardly facing lip 1144 on the inside surface. Ring retainer 1130 defines internal threads proximate to lower end 1134.

Set/reset ring 1150, such as but not limited to a SMALLEY® heavy duty external ring, has an upper side, a lower side, an outside surface, and inside surface 1158. The lower side is adjacent to upper end 1132 of ring retainer 1130. Inside surface 1158 is adjacent to the outside surface of the lower side of gauge ring 1110. Set/reset ring 1150 may have two to five turns, with three turns preventing the ring 1150 from sliding up.

Gauge ring support 1160 has upper end 1162, a lower end, an outside surface, inside surface, and an upper inside surface adjacent upper end 1162. The outside surface is adjacent to the inside surface of ring retainer 1130. The upper inside surface is adjacent to the outside surface of rubber mandrel 1050. Upper end 1162 is adjacent to the lower side of lower resilient sealing element 1100. The outside surface defines upwardly facing annular lip 1169. Upwardly facing annular lip 1169 is for engaging downwardly facing lip 1144 on ring retainer 1130 when ring retainer 1130 is in a relaxed configuration.

Lower centralizing cone 1170 has an upper end, a lower end, an outside surface, and an inside surface. The outside surface has an externally threaded area for receiving internal threads of lower end 1134 of ring retainer 1130 adjacent to the upper end. The inside surface of lower centralizing cone 1170 has a first inside diameter at the upper end, a second inside diameter 1182 at the lower end, and a frusto-conical tapered portion that transitions from the first inside diameter to second inside diameter 1182.

Slick joint 1190 has an upper end, a lower end, and an outside surface. The upper end of slick joint 1190 is received in lower end 1054 of rubber mandrel 1050. Slick joint 1190 is received in lower centralizing cone 1170 wherein a portion of outside surface 1196 of slick joint 1190 is adjacent to second inside diameter 1182 of lower centralizing cone 1170.

In use, rubber mandrel cap 1020 is forced downwards, i.e., to the right in FIGS. 1 and 2, with gauge ring 1030, thereby acting on gauge ring 1040 for compressing upper resilient sealing element 1060, middle resilient sealing element 1080, and lower resilient sealing element 1100. Lower frusto-conical surface 1108 of lower resilient sealing element 1100 acts against upper end 1162 of gauge ring support 1160 and against frusto-conical inner surface 1120 of gauge ring 1110. Gauge ring 1110 is moved downwardly by pressure exerted from lower resilient sealing element 1100 so that lower frusto-conical outer surface 1122 of gauge ring 1110 engages inside surface 1158 of set/reset ring 1150. Frusto-conical inner surface 1120 of gauge ring 1110 may continue to move downwardly until making contact with inside frusto-conical surface 1142 of ring retainer 1130 adjacent upper end 1132 of ring retainer 1130.

Under load, frusto-conical outer surface 1122 of gauge ring 1110 forces set/reset ring 1150 to expand and make contact with casing 1012, thereby preventing extrusion of lower outer resilient sealing element 1100 into a gap between ring retainer 1130 and casing 1012.

Once load is removed, gauge ring 1110 moves upwardly, thereby allowing set/reset ring 1150 to retract and resume its original diameter, thereby resetting the resettable element backup system 1010.

Embodiments of this disclosure can work with any kind of packer sealing element and shape at conventional pressures and temperatures (e.g. 7,000 to 10,000 psi and about 150° F.) as well as high pressure and high temperature (e.g. above 10,000 psi and 350° F. or above). A three-element rubber stack tested by the inventor at 300° F. achieved 6,000 to 7,000 psi before blowout. With a two-turn set/reset ring of this disclosure, a three-element rubber stack under the same test conditions held seal at the limit of the inventor's test fixture (15,000 psi and 300° F.) and passed the API leak rate standard.

In embodiments, the set/reset ring has at least two turns. However, three turns help prevent the ring from moving up and, subsequently, holding greater pressure. In some embodiments, the ring may have up to five turns.

Embodiments may be used in connection with high expansion packers like those used in 5½ inch casing along with ⅜ inch patches to take up space (thereby presenting a restriction to tool OD to get through the patch). Typically, the tool has about a 4-inch OD and can expand to 4½ inches, leaving a ¼-inch gap between the wall and outside of the packer. In embodiments of this disclosure, the tool goes through the patch and can expand to the full casing. Additionally, and unlike prior art systems in which the backup system plastically deforms the packer, the packer may be reset and reused. This is unexpected and surprising.

Although particular embodiments have been described herein, it will be appreciated that the invention is not limited thereto and that many modifications and additions thereto may be made within the scope of the invention. For example, various combinations of the features of the following dependent claims can be made with the features of the independent claims without departing from the scope of the present invention.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

The invention claimed is:

1. A downhole tool comprising:

at least one sealing member arranged to move between an unset and a set position, a set/reset ring arranged to move between an unset diameter at least equal to the unset diameter of the at least one sealing member and a set diameter at least equal to the set diameter of the at least one sealing member, the set/reset ring including at least two full turns and having a 360° face surface when in its unset and set diameters; and a setting mandrel arranged to move in a longitudinal direction toward and away from the at least one sealing member wherein, the at least one sealing member and the set/reset ring are configured to move to the set diameter when the setting mandrel moves toward the at least one sealing member; and wherein, the at least one sealing member and the set/reset ring are configured to return to the unset diameter when the setting mandrel moves away from the at least sealing member; and wherein the unset diameter of the set/reset ring is in a range of 1/16 inch to 1/4 inch greater than the unset diameter of the at least one sealing element.

2. The downhole tool of claim 1, wherein, a force to set the at least one sealing member into the set diameter is greater than the force to return the at least one sealing member to the unset diameter.

3. The downhole tool of claim 2, wherein, the force to set the at least one sealing member into the set diameter is in a range of 10,000 to 15,000 lbs.

4. The downhole tool of claim 2, wherein, the force to return the at least one sealing member to the unset diameter is a reduced setting force no greater than 2,000 lbs.

5. The downhole tool of claim 4, wherein, the set/reset ring starts its return to its unset diameter at the reduced setting force.

6. The downhole tool of claim 1, wherein, the set/reset ring is 17-7 PH spring tempered stainless steel.

7. The downhole tool of claim 1, wherein, the set/reset ring has at least three full turns and no more than five full turns.

8. The downhole tool of claim 1, wherein, the gauge ring includes a face surface including an inset toward the at least one sealing member.

9. The downhole tool of claim 1, wherein, the gauge ring includes a flat face surface toward the at least one sealing member.

10. The downhole tool of claim 1, further comprising a gauge ring located between the at least one sealing member and the set/reset ring, the gauge ring centered on the at least one sealing member.

11. The downhole tool of claim 10, further comprising, a plurality of lugs received by the gauge ring and arranged such that movement is constrained in an axial direction by the gauge ring and allowed in a radial direction relative to the gauge ring, the set/reset ring being arranged about the plurality of lugs.

12. The downhole tool of claim 11, wherein, when the setting mandrel moves toward the at least one sealing member, the plurality of lugs move radially outward and the set/reset ring moves to its set position; and wherein, when the setting mandrel moves away from the at least one sealing member, the plurality of lugs move radially inward and the set/reset ring returns to its unset position.

13. The downhole tool of claim 11, further comprising, a centering ring spaced a predetermined distance from the gauge ring, the set/reset ring being located between the centering ring and the gauge ring.

* * * * *